US011344929B2

(12) United States Patent
D' Agosta

(10) Patent No.: US 11,344,929 B2
(45) Date of Patent: May 31, 2022

(54) PIPE DE-BURRING ASSEMBLY

(71) Applicant: Joseph D' Agosta, Manhattan Beach, CA (US)

(72) Inventor: Joseph D' Agosta, Manhattan Beach, CA (US)

( * ) Notice: Subject to any disclaimer, the term of this patent is extended or adjusted under 35 U.S.C. 154(b) by 468 days.

(21) Appl. No.: 16/414,894

(22) Filed: May 17, 2019

(65) Prior Publication Data

US 2020/0360972 A1 Nov. 19, 2020

(51) Int. Cl.

| | |
|---|---|
| ***B08B 9/02*** | (2006.01) |
| ***A46B 13/02*** | (2006.01) |
| ***B24B 9/00*** | (2006.01) |
| ***A46B 13/00*** | (2006.01) |

(52) U.S. Cl.
CPC ..... *B08B 9/021* (2013.01); *A46B 13/001* (2013.01); *A46B 13/02* (2013.01); *B24B 9/007* (2013.01); *A46B 2200/3013* (2013.01)

(58) Field of Classification Search
CPC ..... B08B 9/021; B24B 9/007; A46B 13/001; A46B 13/02; A46B 2200/3013
See application file for complete search history.

(56) References Cited

U.S. PATENT DOCUMENTS

| | | | | |
|---|---|---|---|---|
| 4,862,549 | A * | 9/1989 | Criswell | A46B 9/02 15/104.04 |
| 5,269,104 | A | 12/1993 | DiBiagio | |
| 6,106,370 | A | 8/2000 | Carter | |
| 6,698,048 | B1 | 3/2004 | Greene | |
| 6,704,964 | B2 | 3/2004 | Knowles | |
| 6,745,425 | B1 * | 6/2004 | Tope | B08B 9/021 15/104.04 |
| 6,769,151 | B1 | 8/2004 | Lin | |
| 6,964,077 | B2 | 11/2005 | Kadinger | |
| D521,241 | S | 5/2006 | Dimmerling | |
| 7,124,882 | B1 | 10/2006 | Jadydy | |
| 8,613,642 | B2 | 12/2013 | Bowles | |
| 9,364,867 | B1 * | 6/2016 | Liao | A46B 13/001 |
| 10,507,569 | B1 * | 12/2019 | Marotta | A46B 13/02 |
| 2003/0172481 | A1 * | 9/2003 | Yehia | B08B 9/021 15/104.04 |
| 2004/0255414 | A1 * | 12/2004 | Tulipana | B08B 9/021 15/104.04 |
| 2006/0218735 | A1 * | 10/2006 | Parker-Smith | A46B 13/02 15/104.05 |
| 2009/0209178 | A1 * | 8/2009 | Vargas | B24B 23/02 451/51 |
| 2009/0235470 | A1 * | 9/2009 | Moisides | B08B 9/021 15/21.1 |

(Continued)

*Primary Examiner* — Weilun Lo

(57) ABSTRACT

A pipe de-burring assembly for de-burring a pipe and a pipe fitting includes a cylinder that has a pair of wells each extending therein to insertably receive a respective one of a pipe and a pipe fitting. A shaft extends lengthwise through the cylinder and the shaft is rotatably coupled to a power tool to rotate the cylinder. A plurality of first bristles is each of the first bristles is coupled to the shaft and each of the first bristles frictionally engages an inside surface of the pipe fitting for de-burring the inside surface of the pipe fitting. A plurality of second bristles is each coupled to the cylinder and each of the second bristles frictionally engages an outside surface of the pipe to de-burr the outside surface of the pipe.

8 Claims, 5 Drawing Sheets

(56) References Cited

U.S. PATENT DOCUMENTS

| | | | | |
|---|---|---|---|---|
| 2010/0122423 | A1* | 5/2010 | Lozar | B08B 9/023<br>15/104.04 |
| 2017/0273449 | A1* | 9/2017 | Lin | B08B 9/023 |
| 2020/0070268 | A1* | 3/2020 | Jenkins | A46B 5/0095 |
| 2020/0353513 | A1* | 11/2020 | Cruz | B08B 9/021 |

* cited by examiner

PIPE DE-BURRING ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to de-burring devices and more particularly pertains to a new de-burring device for de-burring a pipe and a pipe fitting.

BRIEF SUMMARY OF THE INVENTION

An embodiment of the disclosure meets the needs presented above by generally comprising a cylinder that has a pair of wells each extending therein to insertably receive a respective one of a pipe and a pipe fitting. A shaft extends lengthwise through the cylinder and the shaft is rotatably coupled to a power tool to rotate the cylinder. A plurality of first bristles is each of the first bristles is coupled to the shaft and each of the first bristles frictionally engages an inside surface of the pipe fitting for de-burring the inside surface of the pipe fitting. A plurality of second bristles is each coupled to the cylinder and each of the second bristles frictionally engages an outside surface of the pipe to de-burr the outside surface of the pipe.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
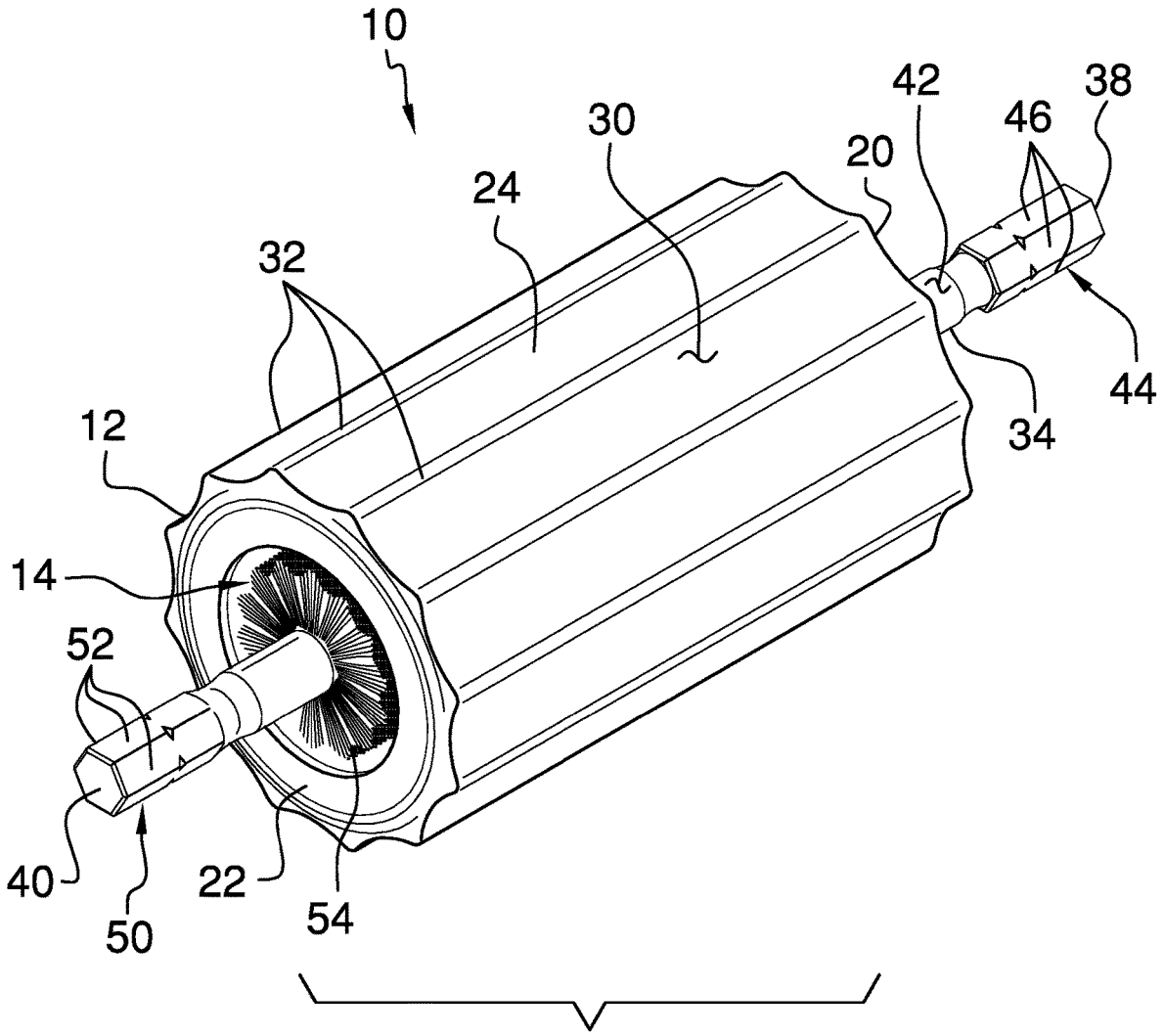
FIG. 1 is a front perspective view of a pipe de-burring assembly according to an embodiment of the disclosure.
Figure 2:
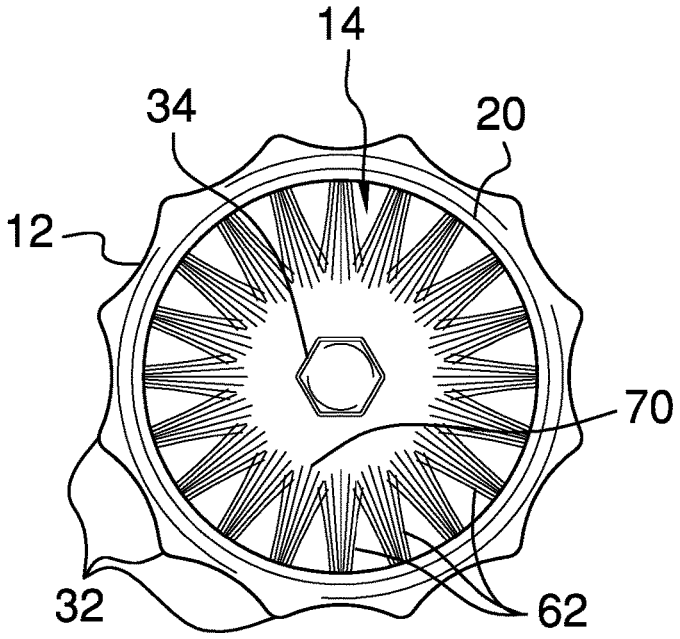
FIG. 2 is a back view of an embodiment of the disclosure.
Figure 3:
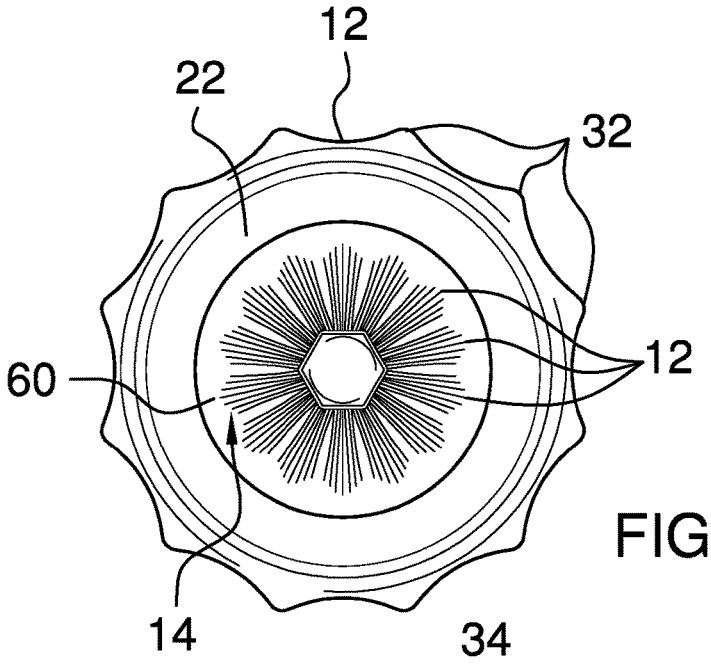
FIG. 3 is a front view of an embodiment of the disclosure.
Figure 4:
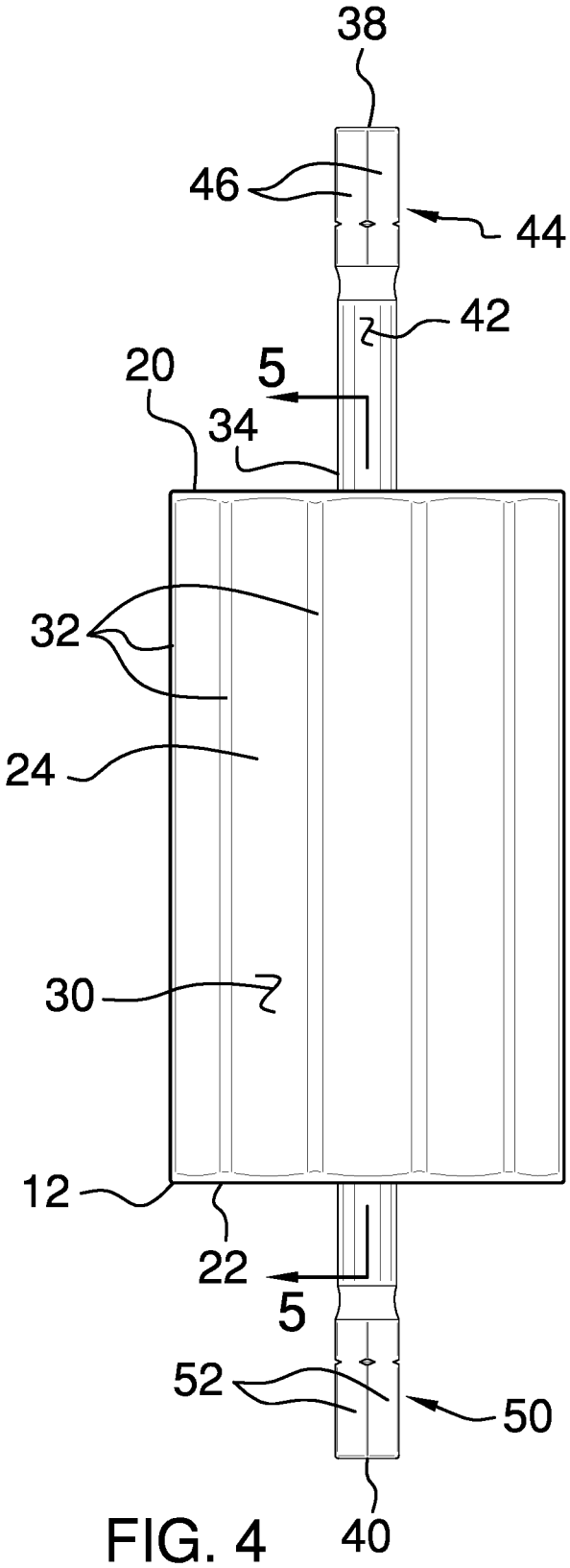
FIG. 4 is a right side view of an embodiment of the disclosure.
Figure 5:
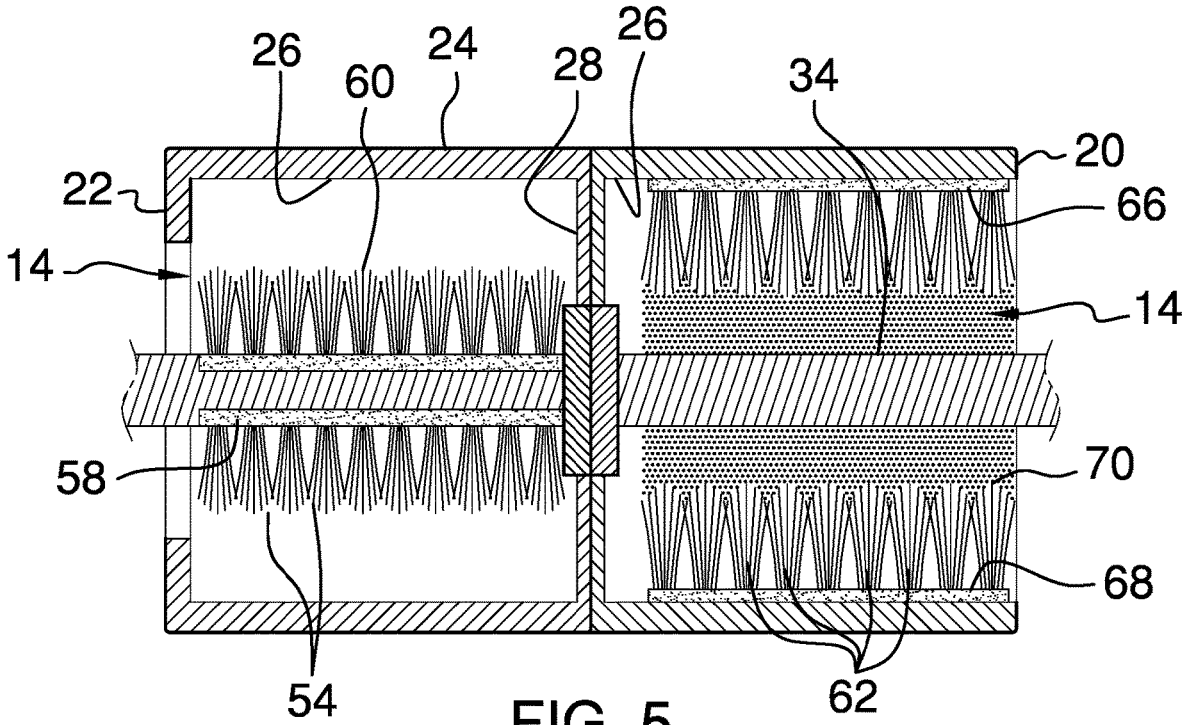
FIG. 5 is a cross sectional view taken along line 5-5 of FIG. 4 of an embodiment of the disclosure.
Figure 6:
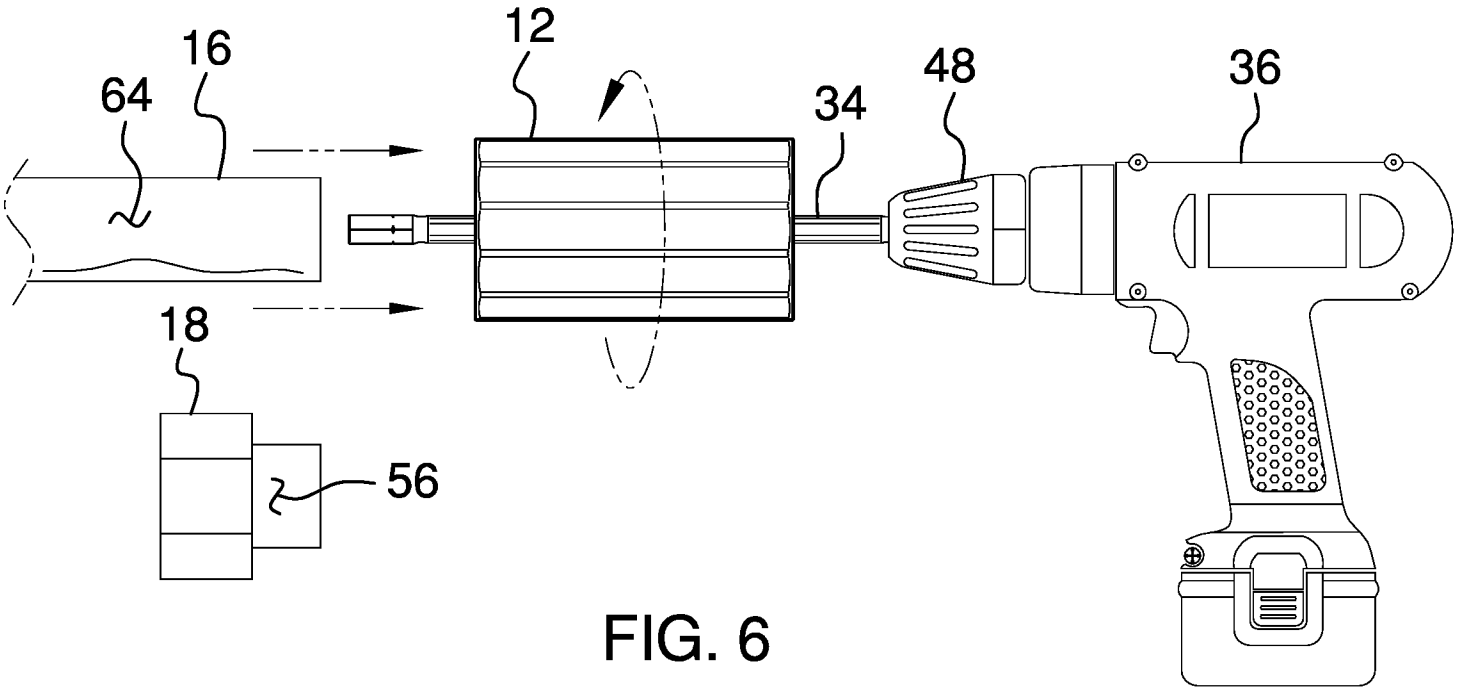
FIG. 6 is a perspective in-use view of an embodiment of the disclosure.

With reference now to the drawings, and in particular to FIGS. 1 through 6 thereof, a new de-burring device embodying the principles and concepts of an embodiment of the disclosure and generally designated by the reference numeral 10 will be described.

As best illustrated in FIGS. 1 through 6, the pipe de-burring assembly 10 generally comprises a cylinder 12 that has a pair of wells 14 each extending therein. Each of the wells 14 insertably receives a respective one of a pipe 16 and a pipe fitting 18. The pipe 16 may be a copper plumbing pipe 16 or the like that has an outside diameter of less than 2.0 inches. Additionally, the pipe fitting 18 may be a copper plumbing fitting of any conventional design that has an inside diameter of less than 2.0 inches.

The cylinder 12 has a first end 20, a second end 22 and an outer wall 24 extending therebetween, and each of the wells 14 extends through a respective one of the first 20 and second 22 ends toward a center of the cylinder 12. Each of the wells 14 has an outer bounding surface 26 and a lower bounding surface 28. The outer wall 24 of the cylinder 12 has an outer surface 30 and the outer surface 30 has a plurality of peaks 32 thereon. Each of the peaks 32 extends between the first 20 and second 22 ends of the cylinder 12. The peaks 32 are spaced apart from each other and are distributed around an entire circumference of the cylinder 12 to enhance gripping the cylinder 12.

A shaft 34 extends lengthwise through the cylinder 12. The shaft 34 is rotatably coupled to a power tool 36, such as an electric drill or the like. In this way the cylinder 12 is rotated about the shaft 34 when the power tool 36 is turned on. The shaft 34 has a primary end 38, a secondary end 40 and an exterior surface 42 extending therebetween. The shaft 34 extends through the lower bounding surface 28 of each of the wells 14 having the shaft 34 being centrally positioned in each of the wells 14. Moreover, the shaft 34 extends outwardly through each of the first 20 and second 22 ends of the cylinder 12 and each of the primary 38 and secondary 40 ends is exposed with respect to the cylinder 12. In this way each of the primary 38 and secondary 40 ends can be rotatably coupled to the power tool 36.

The exterior surface 42 has a first coupling portion 44 extending from the primary end 38 toward the secondary end 40. The first coupling portion 44 has a plurality of intersecting sides 46 each being oriented at an angle with adjacent intersecting sides 46. Thus, the first coupling portion 44 can be engaged by a chuck 48 on the power tool 36. The exterior surface has a second coupling portion 50 extending from the secondary end 40 toward the primary end 38. The second coupling portion 50 has a plurality of intersecting sides 52 each being oriented at an angle with adjacent intersecting sides 52. In this way the second coupling portion 50 can be engaged by the chuck 48 on the power tool 36.

A plurality of first bristles 54 is each coupled to the shaft 34 having each of the first bristles 54 extending outwardly toward the cylinder 12. In this way each of the first bristles 54 frictionally engages an inside surface 56 of the pipe fitting 18 when the pipe fitting 18 is inserted into the well in which the first bristles 54 are positioned. Each of the first bristles 54 is comprised of a rigid material to de-burr the inside surface 56 of the pipe fitting 18.

A first sleeve 58 is coupled around the shaft 34 and the first sleeve 58 is positioned in a respective one of the wells 14. The first sleeve 58 extends from the lower bounding surface 28 of the respective well 14 toward the secondary end 40 of the shaft 34. Each of the first bristles 54 is coupled to the first sleeve 58 and the plurality of first bristles 54 is distributed around an entire circumference of the first sleeve 58. Additionally, the plurality of first bristles 54 is distributed along a full length of the first sleeve 58. Each of the first bristles 54 has a distal end 60 with respect to the first sleeve 58 and the distal end 60 of each of the first bristles 54 is spaced from the outer bounding surface 26 of the well 14 in which the first bristles 54 are positioned.

A plurality of second bristles 62 is each coupled to the cylinder 12 having each of the second bristles 62 extending toward the shaft 34. In this way each of the second bristles 62 frictionally engages an outside surface 64 of the pipe 16 when the pipe 16 is inserted into the well in which the second bristles 62 are positioned. Each of the second bristles 62 is comprised of a rigid material to de-burr the outside surface 64 of the pipe 16.

A second sleeve 66 is positioned within a respective one of the wells 14 and the second sleeve 66 is bonded to the outer bounding surface 26 of the respective well 14. The second sleeve 66 extends from the second end 22 of the cylinder 12 toward the lower bounding surface 28 of the respective well 14. The second sleeve 66 has an inner surface 68 that is directed toward the shaft 34. Each of the second bristles 62 is coupled to the inner surface 68 of the second sleeve 66. The plurality of second bristles 62 is distributed around an entire circumference of the second sleeve 66. Additionally, the plurality of second bristles 62 is distributed along a full length of the second sleeve 66. Each of the second bristles 62 has a distal end 70 with respect to the second sleeve 66 and the distal end 70 of each of the second bristles 62 is spaced from the shaft 34.

In use, the primary end 38 of the shaft 34 is inserted into the chuck 48 on the power tool 36 to de-burr the pipe 16. The pipe 16 is inserted into the well 14 in the second end 22 of the cylinder 12 and the power tool 36 is turned on. Thus, each of the second bristles 62 frictionally engages the pipe 16 and spins around the pipe 16 when the power tool 36 is turned on. In this way the pipe 16 is de-burred prior to being fitted. The secondary end 40 of the shaft 34 is inserted into the chuck 48 on the power tool 36 to de-burr the pipe fitting 18. The pipe fitting 18 is inserted into the well 14 in the first end 20 of the cylinder 12 and the power tool 36 is turned on. Thus, each of the first bristles 54 frictionally engages the pipe fitting 18 and spins within the pipe fitting 18 when the power tool 36 is turned on. In this way the pipe fitting 18 is de-burred prior to being fitted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pipe de-burring assembly being configured to be rotatably mounted to a power tool thereby facilitating a pipe to be de-burred for fitment, said assembly comprising:

a cylinder having a first well and a second well each extending therein wherein each of said first well and said second well is configured to insertably receive a respective one of a pipe and a pipe fitting;

a shaft extending lengthwise through said cylinder, said shaft being rotatably coupled to a power tool wherein said cylinder is configured to be rotated about said shaft when said power tool is turned on;

a plurality of first bristles, each of said first bristles being coupled to said shaft having each of said first bristles extending outwardly toward said cylinder wherein each of said first bristles is configured to frictionally engage an inside surface of the pipe fitting when the pipe fitting is inserted into said first well in which said first bristles are positioned, each of said first bristles being comprised of a rigid material wherein each of said first bristles is configured to de-burr the inside surface of the pipe fitting;

a plurality of second bristles, each of said second bristles being coupled to said cylinder having each of said second bristles extending toward said shaft wherein each of said second bristles is configured to frictionally engage an outside surface of the pipe when the pipe is inserted into said second well in which said second bristles are positioned, each of said second bristles being comprised of a rigid material wherein each of said second bristles is configured to de-burr the outside surface of the pipe;

wherein said cylinder has a first end, a second end and an outer wall extending therebetween, each of said wells extending from a respective one of said first and second ends toward a center of said cylinder, each of said wells having an outer bounding surface and a lower bounding surface, said outer wall having an outer surface;

said outer surface has a plurality of peaks thereon, each of said peaks extending between said first and second ends of said cylinder, said peaks being spaced apart from each other and being distributed around an entire circumference of said cylinder wherein each of said peaks is configured to enhance gripping said cylinder; and wherein said shaft has a primary end, a secondary end and an exterior surface extending therebetween, said shaft extending through said lower bounding surface of each of said wells having said shaft being centrally positioned in each of said wells, said shaft extending outwardly through each of said first and second ends of said cylinder having each of said primary and secondary ends being exposed with respect to said cylinder wherein each of said primary and secondary ends is configured to be rotatably coupled to the power tool.

2. The assembly according to claim 1, wherein said exterior surface has a first coupling portion extending from said primary end toward said secondary end, said first coupling portion having a plurality of intersecting sides each being oriented at an angle with adjacent intersecting sides wherein said first coupling portion is configured to be engaged by a chuck on the power tool.

3. The assembly according to claim 2, wherein said exterior surface has a second coupling portion extending from said secondary end toward said primary end, said second coupling portion having a plurality of intersecting sides each being oriented at an angle with adjacent intersecting sides wherein said second coupling portion is configured to be engaged by the chuck on the power tool.

4. The assembly according to claim 1, further comprising a first sleeve being coupled around said shaft, said first sleeve being positioned in said first well, said first sleeve extending from said lower bounding surface of said first well toward said secondary end of said shaft.

5. The assembly according to claim 4, wherein each of said first bristles is coupled to said first sleeve, said plurality of first bristles being distributed around an entire circumference of said first sleeve, said plurality of first bristles being distributed along a full length of said first sleeve, each of said first bristles having a distal end with respect to said first sleeve, said distal end of each of said first bristles being spaced from said outer bounding surface of said well in which said first bristles are positioned.

6. The assembly according to claim 5, further comprising a second sleeve being positioned within said second well, said second sleeve being bonded to said outer bounding surface of said second well, said second sleeve extending from said second end of said cylinder toward said lower bounding surface of said second well, said second sleeve having an inner surface being directed toward said shaft.

7. The assembly according to claim 6, wherein each of said second bristles is coupled to said inner surface of said second sleeve, said plurality of second bristles being distributed around an entire circumference of said second sleeve, said plurality of second bristles being distributed along a full length of said second sleeve, each of said second bristles having a distal end with respect to said second sleeve, said distal end of each of said second bristles being spaced from said shaft.

8. A pipe de-burring assembly being configured to be rotatably mounted to a power tool thereby facilitating a pipe to be de-burred for fitment, said assembly comprising:

a cylinder having a first well and a second well each extending therein wherein each of said first well and said second well is configured to insertably receive a respective one of a pipe and a pipe fitting, said cylinder having a first end, a second end and an outer wall extending therebetween, each of said first well and said second well extending from a respective one of said first and second ends toward a center of said cylinder, each of said first well and said second well having an outer bounding surface and a lower bounding surface, said outer wall having an outer surface, said outer surface having a plurality of peaks thereon, each of said peaks extending between said first and second ends of said cylinder, said peaks being spaced apart from each other and being distributed around an entire circumference of said cylinder wherein each of said peaks is configured to enhance gripping said cylinder;

a shaft extending lengthwise through said cylinder, said shaft being rotatably coupled to a power tool wherein said cylinder is configured to be rotated about said shaft when said power tool is turned on, said shaft having a primary end, a secondary end and an exterior surface extending therebetween, said shaft extending through said lower bounding surface of each of said first well and said second well having said shaft being centrally positioned in each of said first well and said second well, said shaft extending outwardly through each of said first and second ends of said cylinder having each of said primary and secondary ends being exposed with respect to said cylinder wherein each of said primary and secondary ends is configured to be rotatably coupled to the power tool, said exterior surface having a first coupling portion extending from said primary end toward said secondary end, said first coupling portion having a plurality of intersecting sides each being oriented at an angle with adjacent intersecting sides wherein said first coupling portion is configured to be engaged by a chuck on the power tool, said exterior surface having a second coupling portion extending from said secondary end toward said primary end, said second coupling portion having a plurality of intersecting sides each being oriented at an angle with adjacent intersecting sides wherein said second coupling portion is configured to be engaged by the chuck on the power tool;

a first sleeve being coupled around said shaft, said first sleeve being positioned in said first well, said first sleeve extending from said lower bounding surface of said first well toward said secondary end of said shall;

a plurality of first bristles, each of said first bristles being coupled to said shaft having each of said first bristles extending outwardly toward said cylinder wherein each of said first bristles is configured to frictionally engage an inside surface of the pipe fitting when the pipe fitting is inserted into said first well in which said first bristles are positioned, each of said first bristles being comprised of a rigid material wherein each of said first bristles is configured to de-burr the inside surface of the pipe fitting, each of said first bristles being coupled to said first sleeve, said plurality of first bristles being distributed around an entire circumference of said first sleeve, said plurality of first bristles being distributed along a full length of said first sleeve, each of said first bristles having a distal end with respect to said first sleeve, said distal end of each of said first bristles being spaced from said outer bounding surface of said first well in which said first bristles are positioned;

a second sleeve being positioned within said second well, said second sleeve being bonded to said outer bounding surface of said second well, said second sleeve extending from said second end of said cylinder toward said tower bounding surface of said second well, said second sleeve having an inner surface being directed toward said shall; and a plurality of second bristles, each of said second bristles being coupled to said cylinder having each of said second bristles extending toward said shaft wherein each of said second bristles is configured to frictionally engage an outside surface of the pipe when the pipe is inserted into said second well in which said second bristles are positioned, each of said second bristles being comprised of a rigid material wherein each of said second bristles is configured to de-burr the outside surface of the pipe, each of said second bristles being coupled to said inner surface of said second sleeve, said plurality of second bristles being distributed around an entire circumference of said second sleeve, said plurality of second bristles being distributed along a full length of said second sleeve, each of said second bristles having a distal end with respect to said second sleeve, said distal end of each of said second bristles being spaced from said shaft.

* * * * *